US007321192B2

(12) United States Patent
Hayashida

(10) Patent No.: US 7,321,192 B2
(45) Date of Patent: Jan. 22, 2008

(54) IMAGE DISPLAY APPARATUS

(75) Inventor: Matsuya Hayashida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/240,504

(22) Filed: Oct. 3, 2005

(65) Prior Publication Data

US 2007/0236150 A1 Oct. 11, 2007

(30) Foreign Application Priority Data

Oct. 26, 2004 (JP) ..... 2004-310738

(51) Int. Cl.
*H01J 1/62* (2006.01)

(52) U.S. Cl. ..... 313/497; 313/495

(58) Field of Classification Search ..... 313/497, 313/496, 495, 483, 461
See application file for complete search history.

(56) References Cited

U.S. PATENT DOCUMENTS 5,347,201 A * 9/1994 Liang et al. ..... 315/366
5,739,522 A * 4/1998 Ouimette ..... 250/214 VT
5,747,927 A * 5/1998 Namikawa et al. ..... 313/495
5,869,919 A * 2/1999 Sato et al. ..... 313/17
6,005,351 A * 12/1999 Sverdrup et al. ..... 315/169.1
6,600,263 B1 * 7/2003 Ito ..... 313/495
2002/0084997 A1 * 7/2002 Ohnishi ..... 345/211
2006/0061258 A1 3/2006 Tagawa et al. ..... 313/496

FOREIGN PATENT DOCUMENTS

JP 3-261024 11/1991
JP 11-250839 9/1999
JP 2001-176432 6/2001
KR 10-2004-0033324 4/2004
WO WO 03/030205 A1 4/2003

* cited by examiner

*Primary Examiner*—Vip Patel
(74) *Attorney, Agent, or Firm*—Fitzpatrick, Cella, Harper & Scinto

(57) ABSTRACT

In an image display apparatus including: an electron source; a target having a phosphor and an anode electrode, the target emits light for display by being illuminated with electrons from the electron source; and an intermediate electrode disposed in the midpoint between the electron source and the target, the intermediate electrode is applied with a potential greater than that applied to the anode electrode. Thereby, halation caused by back scattering electrons reentering a phosphor is reduced.

5 Claims, 2 Drawing Sheets

IMAGE DISPLAY APPARATUS

BACKGROUND OF THE INVENTION

1. Field of the Invention

The present invention relates to an image display apparatus using an electron source.

2. Related Background Art

Japanese Patent Application Laid-Open H03-261024 discloses a spontaneous light emitting type flat display, which displays an image by illuminating a phosphor with an electron beam emanated from an electron source to generate fluorescence. The flat display is a thin image display apparatus constituted by placing an electron-emitting device for generating an electron beam within a vacuum panel sandwiched between a face plate and a rear plate. In the image display apparatus, a surface conduction electron-emitting device is employed as the electron-emitting device, and the electron beam is accelerated and irradiated onto the phosphor to cause the phosphor to emit light for displaying an image.

Japanese Patent Application Laid-Open H11-250839 discloses an image display apparatus with reduced halation, which is caused by back scattering electrons, generated by a phosphor illuminated with an electron beam, reentering the phosphor and causing it to emit light in unwanted portions; providing high-definition, high-contrast and purer spectral colors.

FIG. 4 is a schematic sectional view illustrating a planar image display apparatus disclosed in Japanese Patent Application Laid-Open H11-250839.

In this image display apparatus, an electron-emitting device 202 is formed on an insulating substrate 201. A grid 204 is a modulating electrode having a passage hole for the electron beam, and is mounted on an insulating layer 203. A transparent conductive ITO (indium tin oxide) film 211, a phosphor 206 and an aluminum film 210 provided for improving luminous efficiency are formed on the panel side of a face plate substrate 205, over which a graphite film 207 is formed to avoid back scattering electrons.

An electroconductive capturer 213 has an opened portion 214 for passing an electron ray emanated from the surface conduction electron-emitting device 202, and an unopened portion 215 for capturing the back scattering electrons from the face plate substrate 205 side, and is maintained at a predetermined distance from the face plate by means of a partition member 216.

Using glass frit 208, the face plate substrate 205 and the substrate 201 are sealed, having an outer frame 209 in-between, to constitute a vacuum enclosure. A surface conduction electron-emitting device 202 is connected to an outer drive circuit (not shown), and the graphite film 207, aluminum film 210 and ITO film 211 are connected to a high voltage power supply (not shown) by a high voltage cable which is not shown.

In the image display apparatus described above, the internal pressure is maintained at vacuum of approximate $10^{-4}$ Pa, and electrons are emanated in the form of an electron beam when driving pulse voltage is applied to the surface conduction electron-emitting device 202 by the outer drive circuit. The electron beam passes the grid 204, and is accelerated by positive high voltage applied to the phosphor 206 and the aluminum film 210 from the high voltage power supply to emit fluorescence upon impinging on the phosphor 206.

As an electron source, in addition to using a surface conduction electron-emitting device, it is known to use a thermal electron source using a hot cathode, a field emission type electron-emitting device or a metal/insulating layer/metal type electron-emitting device.

In a planar image display apparatus as described above, the smaller opened portion of the electroconductive capturer increases the capture rate of the back scattering electrons, and as a result, improves the effect of reducing halation. However, the opened portion also functions to pass an electron beam (primary electron) emanated from the electron source, and the smaller opened portion prevents more primary electrons from passing through, reducing brightness and luminous efficiency. For this reason, a problem arises in that it has been difficult to make the opened portion smaller to a width such that enough back scattering electrons can be captured, which results in poor reduction of halation.

SUMMARY OF THE INVENTION

It is an object of the present invention to provide an image display apparatus capable of reducing halation caused by back scattering electrons reentering a phosphor. The invention is an image display apparatus, comprising: an electron source; a target having a phosphor and an anode electrode, the target being illuminated with electrons from the electron source; and an intermediate electrode disposed between the electron source and the target, wherein the intermediate electrode is applied with a potential greater than that applied to the anode electrode.

DESCRIPTION OF THE PREFERRED EMBODIMENTS

An image display apparatus according to the present invention comprises an electron source, a target having a phosphor and an anode electrode that are irradiated with electrons from the electron source, an intermediate electrode disposed between the electron source and the target, in which a voltage is applied to the intermediate electrode that is higher than the voltage applied to the anode electrode.

The image display apparatus according to the present invention described above can reduce the halation caused by a back-scattered electron reentering the phosphor.

Now, an embodiment of the present invention will be described with reference to the drawings.

Figure 1:
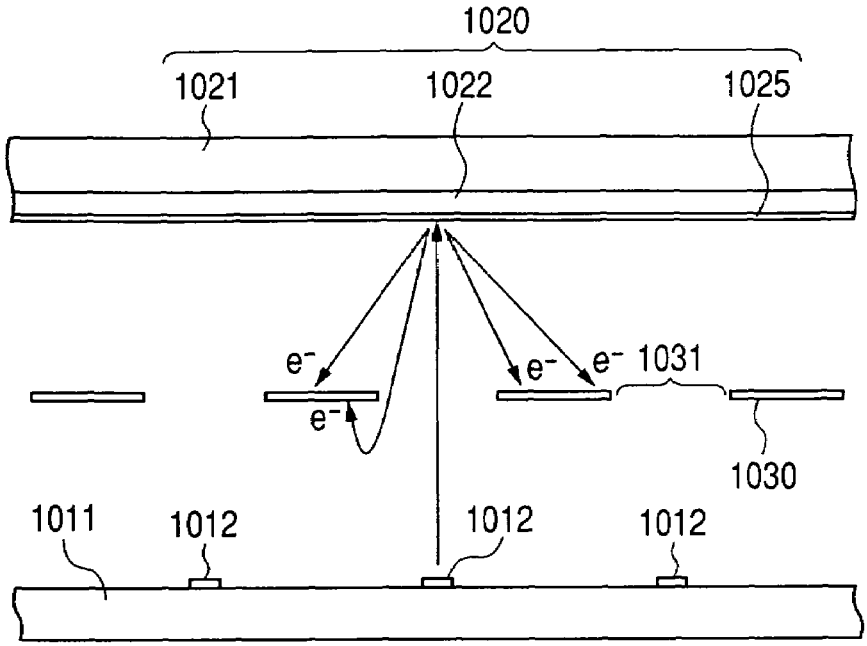
FIG. 1 is a schematic view of an embodiment of an image display apparatus according to the invention.

FIG. 1 is a schematic diagram showing an image display apparatus according to an embodiment of the present invention.

The image display apparatus according to this embodiment has an insulating substrate 1011 and a transparent substrate 1021 facing each other and spaced apart from each other.

The insulating substrate 1011 has a plurality of electron sources 1012 on a surface thereof. The electron sources 1012 are not limited to a particular type and may be any electron source suitable for image display apparatus, such as a thermoelectron source using a thermal cathode, a field emission electron-emitting element, a metal/insulator/metal (semiconductor) electron-emitting element, and a surface conduction electron-emitting element.

On the other hand, the transparent substrate 1021 has a phosphor 1022 on a surface thereof facing to the insulating substrate 1011 and an anode electrode 1025 overlaid on the phosphor 1022, and the phosphor 1022 and the anode electrode 1025 constitute a target 1020. The transparent substrate 1021 is desirably made of an insulating material, and the anode electrode 1025 is desirably made of a material that is electroconductive and has a high visible-light reflectivity and a high electron transmittance.

While the anode electrode 1025 is formed on the surface of the phosphor 1022 in the example shown in FIG. 1, the anode electrode may be formed on the surface of the transparent substrate 1021. In that case, the anode electrode is desirably made of an electroconductive transparent material. Alternatively, an anode electrode made of an electroconductive material having a high visible light reflectivity and a high electron transmittance may be formed on the surface on the phosphor 1022, and at the same time, an anode electro made of an electroconductive transparent material may be formed on the surface of the transparent substrate 1021. In other words, anode electrodes may be formed both on the surface of the phosphor 1022 and the surface of the transparent substrate 1021.

Furthermore, the image display apparatus according to this embodiment has an intermediate electrode 1030 having an electron-passing opening 1031 that is disposed at a predetermined distance from the anode electrode 1025 between the insulating substrate 1011 and the transparent substrate 1021. For example, the intermediate electrode 1030 is preferably made of a conductive material, such as Fe and Invar, and the thermal expansion coefficient thereof is preferably as close to that of the transparent substrate or insulating substrate as possible.

In the image display apparatus according to this embodiment, a voltage equal to or higher than the lowest voltage required to make the phosphor 1022 emit light is applied to the anode electrode 1025, and a voltage higher than the voltage applied to the anode electrode 1025 is applied to the intermediate electrode 1030. Consequently, a back-scattered electron produced by irradiation of the phosphor 1022 with an electron beam having been emitted from the electron source 1012 and passed through the electron-passing opening 1031 in the intermediate electrode 1030 is attracted and collected by the intermediate electrode 1030. Thus, the halation is reduced that can be caused by the back-scattered electron reentering the phosphor 1022. However, the voltage applied to the intermediate electrode 1030 is preferably limited up to 1.2 times as high as the voltage applied to the anode electrode 1025, because an excessively great voltage difference between the intermediate electrode 1030 and the anode electrode 1025 may cause discharge between the electrodes. In other words, supposing that the voltage applied to the anode electrode 1025 is denoted by Va, and the voltage applied to the intermediate electrode 1030 is denoted by Vb, it is preferred that a relation "$Va<Vb\leqq Va*1.2$" is satisfied.

Furthermore, the target 1020 may have a supporting member (not shown), and the intermediate electrode 1030 may be formed on the supporting member. In that case, the supporting member is preferably made of an insulating material or a high resistance material.

Furthermore, the intermediate electrode 1030 according to this embodiment is not limited to the planar shape with the electron-passing opening 1031 and may be ribbon-like shaped or wire-like shaped, for example. Furthermore, in order to facilitate patterning of the intermediate electrode 1030, the intermediate electrode 1030 may be formed in the shape of a thin film.

EXAMPLE

In the following, the present invention will be described in mode detail with reference to examples.

First Example

Figure 2:
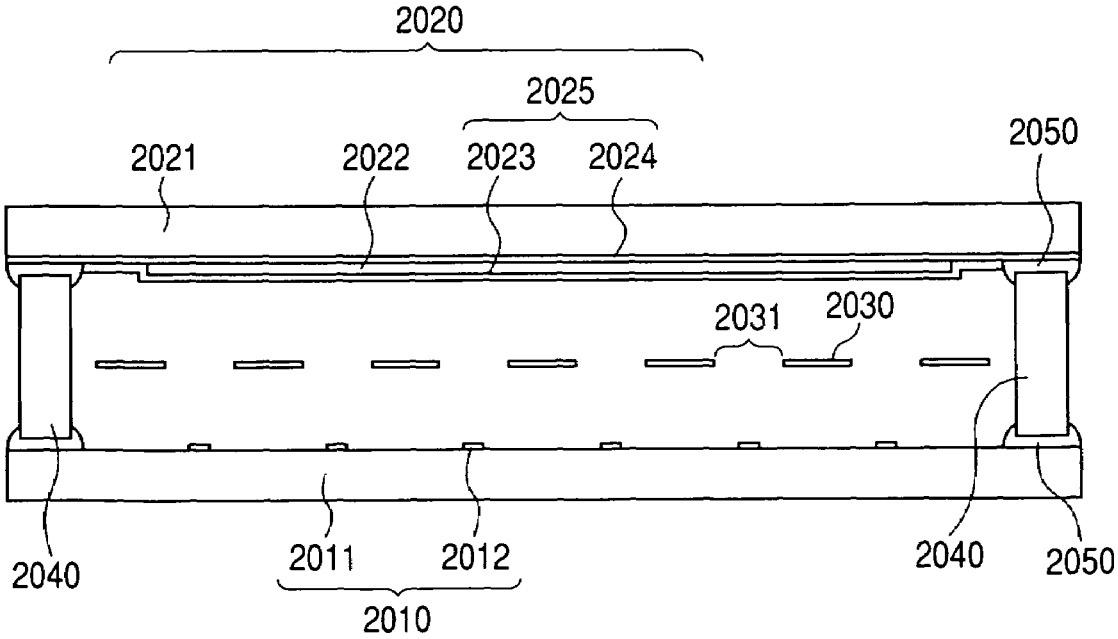
FIG. 2 is a sectional view illustrating a first example of an image display apparatus according to the invention.

FIG. 2 is a cross-sectional view of an image display apparatus according to a first example of the present invention.

As shown in FIG. 2, the image display apparatus according to this example has a rear plate 2010 and a face plate 2020 facing each other and spaced apart from each other with an outer frame 2040 interposed therebetween.

The rear plate 2010 comprises a rear plate substrate 2011 made of high strain point glass and a surface conduction electron-emitting element 2012 disposed thereon. On the other hand, the face plate 2020 has a face plate substrate 2021 made of high strain point glass, an ITO film 2024, which is a transparent electroconductive film, overlaid on an inner surface of the face plate substrate 2021 (a surface thereof facing to the rear plate substrate 2011), and a phosphor 2022 overlaid on the ITO film 2024. Furthermore, in order to improve light emission efficiency, a metal back 2023 is formed on the surface of the phosphor 2022. The ITO film 2024 and the metal back 2023 constitute an anode electrode 2025. Alternatively, the anode electrode 2025 may be constituted by one of the ITO film 2024 and the metal back 2023.

The image display apparatus according to this example also has an intermediate electrode 2030 having an electron-passing opening 2031 between the rear plate 2010 and the face plate 2020. The intermediate electrode 2030 is fixed using an adhesive to the rear plate 2010 via a spacer (not shown) at a distance of about 2 mm from the rear plate 2010. Alternatively, the intermediate electrode 2030 may be fixed to the face plate 2020 via a space (not shown).

Between the face plate 2020 and the rear plate 2010, there is interposed the outer frame 2040 having a thickness that allows the intermediate electrode 2030 and the face plate 2020 to be spaced apart from each other by about 2 mm. The periphery of the outer frame 2040 and the plates 2010 and 2020 are sealed with frit glass 2050. The inner space defined by the plates 2010 and 2020 and the outer frame 2040 is maintained substantially under vacuum (at a pressure of about $10^{-4}$ Pa). In this way, the plates 2010 and 2020 and the outer frame 2040 constitute a vacuum envelope.

The surface conduction electron-emitting element 2012 is connected to an external driving circuit (not shown) provided outside the vacuum envelope. In addition, the intermediate electrode 2030 is connected to a high voltage power supply (not shown) via a high voltage cable (not shown), the anode electrode 2025 is connected to the intermediate electrode 2030 via a resistor (not shown), and the intermediate electrode 2030 and the anode electrode 2025 are fixed at their respective predetermined voltages. According to this configuration, the voltage of the anode electrode 2025 is lower than the voltage of the intermediate electrode 2030 because of the presence of the resistor, so that the voltage can be applied to the intermediate electrode 2030 that is higher than the voltage applied to the anode electrode 2025.

In this example, specifically, a voltage of 10 kV is applied to the anode electrode 2025, and a voltage of 10.5 kV is applied to the intermediate electrode 2030. If the voltage difference between the anode electrode 2025 and the intermediate electrode 2030 is excessively great, a discharge occurs between the electrodes and damages the phosphor 2022. Thus, in this example, the voltage difference between the anode electrode 2025 and the intermediate electrode 2030 is set at 0.5 kV, in order to prevent occurrence of such a discharge. Here, it is to be noted that the voltages applied to the electrodes 2025 and 2030 are not limited to the values described above. The voltage applied to the intermediate electrode 2030 can be readily adjusted by adjusting the high voltage power supply, and the voltage applied to the anode electrode 2025 can be readily adjusted by changing the value of resistance of the resistor.

In the configuration described above, one high voltage power supply and one resistor are used. However, in an alternative configuration, a high voltage power supply for applying a voltage to the anode electrode 2025 may be provided in addition to the high voltage power supply for applying a voltage to the intermediate electrode 2030. In that case, the resistor described above can be omitted.

An electric signal is transmitted from the external driving circuit to the image display apparatus fabricated as described above to drive the image display apparatus, thereby making the image display apparatus display an image. In the image display apparatus according to this example, because a back-scattered electron is attracted to the intermediate electrode 2030, the back-scattered electron is prevented from reentering the phosphor 2022. Therefore, the image display apparatus according to this example reduces the halation intensity by about 30% or more, depending on the voltage difference between the anode electrode 2025 and the intermediate electrode 2030, the distance between the face plate 2020 and the intermediate electrode 2030 or the like. Furthermore, it is recognized that the color purity is improved as a result of the reduction of halation intensity.

Second Example

Figure 3:
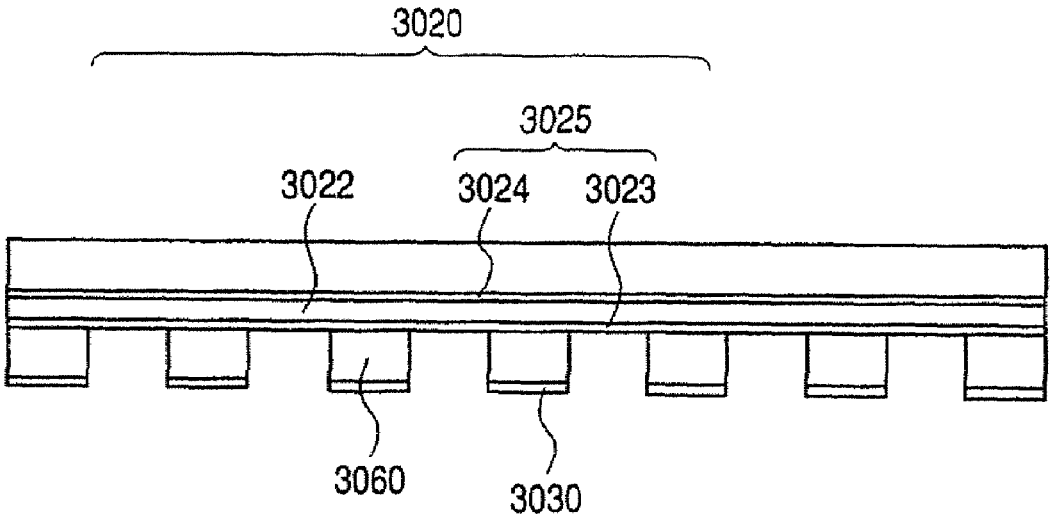
FIG. 3 is a sectional view illustrating essential parts of a second example of an image display apparatus according to the invention.
Figure 4:
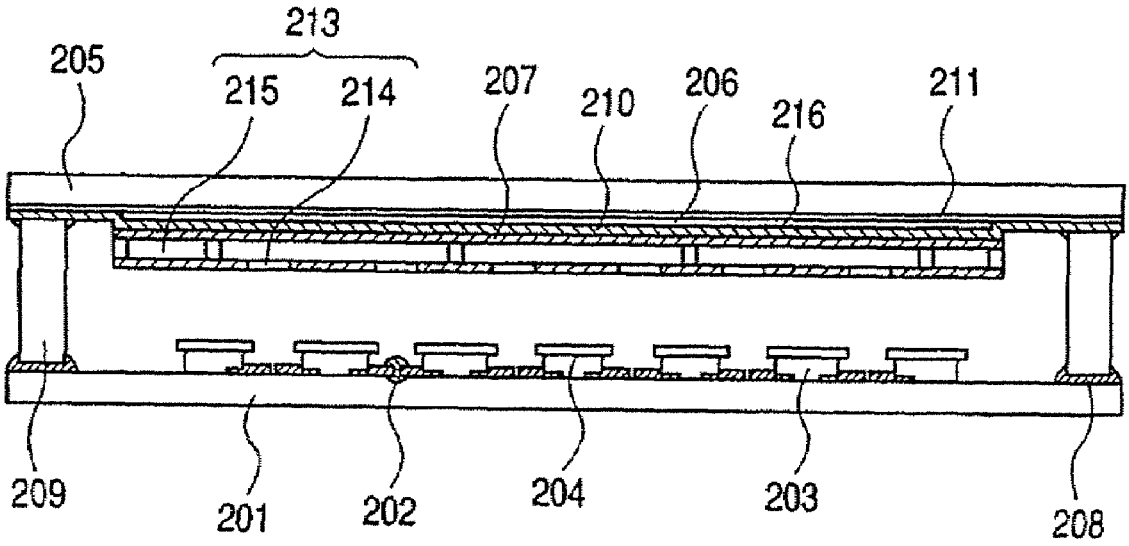
FIG. 4 Prior Art
FIG. 4 is a schematic sectional view illustrating a conventional planar image display apparatus.

FIG. 3 is a cross-sectional view showing essential parts of an image display apparatus according to a second example of the present invention. The rear plate and the outer frame of the image display apparatus according to this example are the same as those according to the first example shown in FIG. 2 and, therefore, will not be further described below.

In this example, a supporting member 3060 made of an insulating material is formed on a surface of a face plate 3020 facing the rear plate (not shown), and an intermediate electrode 3030 is formed on the supporting member 3060. The intermediate electrode 3030 according to this example is composed of a thin film of aluminum deposited on the supporting member 3060 by mask deposition, for example.

In this example also, the intermediate electrode 3030 is connected to a high voltage power supply (not shown) via a high voltage cable (not shown), an anode electrode 3025 is connected to the intermediate electrode 3030 via a resistor (not shown), and thus, the intermediate electrode 3030 and the anode electrode 3025 are fixed at their respective predetermined voltages. Alternatively, the supporting member 3060 may be made of a high resistance material, and the electrical resistance of the supporting member 3060 can be appropriately changed to adjust the voltage applied to the anode electrode 3025 formed from electrodes 3023 and 3024.

It is recognized that the image display apparatus according to this example also can reduce the halation by reducing the number of back-scattered electrons that reenter a phosphor 3022.

This application claims priority from Japanese Patent Application No. 2004-310738 filed Oct. 26, 2004, which is hereby incorporated by reference herein.

What is claimed is:

1. An image display apparatus, comprising:

an electron source;

a target having a phosphor and an anode electrode, the target being illuminated with electrons from the electron source; and an intermediate electrode disposed between the electron source and the target, wherein the intermediate electrode is formed on a supporting member provided on a side of the target opposite to the electron source, wherein the intermediate electrode is connected to a power source and is applied with a potential greater than that applied to the anode electrode, and wherein the anode electrode is connected through a resistor to the intermediate electrode.

2. The image display apparatus according to claim 1, wherein the anode electrode is applied with a potential equal to or greater than a minimum potential required by the phosphor to emit light.

3. The image display apparatus according to claim 1, wherein the following relation is satisfied:

$$Va < Vb \leqq Va \times 1.2$$

where Va is the potential applied to the anode electrode, and Vb is the potential applied to the intermediate electrode.

4. The image display apparatus according to claim 1, wherein a supporting member is provided on a side of the target opposite to the electron source, and the intermediate electrode is formed on the supporting member.

5. The image display apparatus according to claim 1, wherein the intermediate electrode consists of a thin film.

* * * * *

UNITED STATES PATENT AND TRADEMARK OFFICE

CERTIFICATE OF CORRECTION

PATENT NO. : 7,321,192 B2
APPLICATION NO. : 11/240504
DATED : January 22, 2008
INVENTOR(S) : Matsuya Hayashida It is certified that error appears in the above-identified patent and that said Letters Patent is hereby corrected as shown below:

COLUMN 3

Line 23, “electro” should read --electrode--.

Signed and Sealed this

Nineteenth Day of August, 2008

JON W. DUDAS
*Director of the United States Patent and Trademark Office*

UNITED STATES PATENT AND TRADEMARK OFFICE

CERTIFICATE OF CORRECTION

PATENT NO. : 7,321,192 B2
APPLICATION NO. : 11/240504
DATED : January 22, 2008
INVENTOR(S) : Matsuya Hayashida It is certified that error appears in the above-identified patent and that said Letters Patent is hereby corrected as shown below:

COLUMN 3

Line 23, “electro” should read --electrode--.

Signed and Sealed this

Second Day of September, 2008

JON W. DUDAS
*Director of the United States Patent and Trademark Office*